US007036234B2

(12) United States Patent
Rager

(10) Patent No.: US 7,036,234 B2
(45) Date of Patent: May 2, 2006

(54) BOW SIGHT HAVING VERTICAL, IN-LINE SIGHT PINS, AND METHODS

(75) Inventor: Christopher A. Rager, Bozeman, MT (US)

(73) Assignee: Trophy Ridge, LLC, Belgrade, MT (US)

( * ) Notice: Subject to any disclaimer, the term of this patent is extended or adjusted under 35 U.S.C. 154(b) by 178 days.

(21) Appl. No.: 10/406,733

(22) Filed: Apr. 3, 2003

(65) Prior Publication Data

US 2003/0208916 A1 Nov. 13, 2003

Related U.S. Application Data

(63) Continuation-in-part of application No. 10/196,333, filed on Jul. 16, 2002, now Pat. No. 6,892,462, which is a continuation of application No. 09/607,243, filed on Jun. 30, 2000, now Pat. No. 6,418,633.

(51) Int. Cl.
*F41G 1/467* (2006.01)

(52) U.S. Cl. ..... 33/265; 42/138; 124/87

(58) Field of Classification Search ..... 33/365; 124/87; 42/136–139
See application file for complete search history.

(56) References Cited

U.S. PATENT DOCUMENTS

| | | | | | |
|---|---|---|---|---|---|
| 3,056,206 | A | * | 10/1962 | Moore | 33/265 |
| 3,163,937 | A | * | 1/1965 | Reynolds | 33/265 |
| 3,234,651 | A | | 2/1966 | Rivers | 33/265 |
| 3,455,027 | A | | 7/1969 | Perkins | 33/265 |
| 3,475,820 | A | | 11/1969 | Kerman | 33/265 |
| 3,574,944 | A | * | 4/1971 | Reynolds | 33/265 |
| 3,997,974 | A | | 12/1976 | Larson | 33/265 |
| 4,120,096 | A | | 10/1978 | Keller | 33/265 |
| 4,244,115 | A | | 1/1981 | Waldorf | 33/265 |
| 4,291,664 | A | | 9/1981 | Nishioka | 124/87 |
| 4,977,678 | A | | 12/1990 | Sears | 33/265 |
| 5,086,567 | A | | 2/1992 | Tutsch | 33/265 |
| 5,103,568 | A | | 4/1992 | Canoy | 33/265 |
| 5,131,153 | A | | 7/1992 | Seales | 33/265 |
| 5,362,046 | A | | 11/1994 | Sims | 473/300 |
| 5,379,746 | A | * | 1/1995 | Sappington | 124/87 |
| 5,383,279 | A | | 1/1995 | Tami | 33/265 |
| 5,442,861 | A | | 8/1995 | Lorocco | 124/87 |
| 5,442,863 | A | | 8/1995 | Fazely | 33/265 |
| 5,560,113 | A | * | 10/1996 | Simo et al. | 33/265 |
| 5,634,278 | A | | 6/1997 | London | 124/87 |
| 5,638,604 | A | | 6/1997 | Lorocco | 42/132 |
| 5,653,217 | A | | 8/1997 | Keller | 124/87 |
| 5,676,122 | A | | 10/1997 | Wiseby et al. | 124/87 |
| 5,685,081 | A | | 11/1997 | Winegar | 33/265 |

(Continued)

OTHER PUBLICATIONS

Majestic Hunter bow sight from Altier Archery. (One page description with 8 photographs), Jun. 2000.

(Continued)

*Primary Examiner*—Randy W. Gibson
(74) *Attorney, Agent, or Firm*—Merchant & Gould P.C.

(57) ABSTRACT

A bow sight having a support structure, and at least one pin connected to the support structure, the pin having a sight point. The support structure can be movably connected to a mounting base for attachment to a bow. The support structure is movable from a first position to a second position, thus changing the position of the pin in respect to the archer. In a preferred embodiment, when in the first position, the pin extends vertically and when in the second position, the pin extends horizontally.

19 Claims, 12 Drawing Sheets

U.S. PATENT DOCUMENTS

| | | | | |
|---|---|---|---|---|
| 5,836,294 | A | 11/1998 | Merritt | 124/87 |
| 5,956,854 | A | 9/1999 | Lorocco | 42/132 |
| 6,016,608 | A | 1/2000 | Lorocco | 33/265 |
| 6,154,971 | A | 12/2000 | Perkins | 33/265 |
| 6,276,068 | B1 | 8/2001 | Sheliga | 33/265 |
| 6,397,483 | B1 | 6/2002 | Perkins | 33/265 |
| 6,418,633 | B1 | 7/2002 | Rager | 33/265 |
| 6,463,665 | B1 * | 10/2002 | Gomez-Vazquez | 33/265 |
| 6,477,778 | B1 * | 11/2002 | Lorocco | 33/265 |
| 6,508,005 | B1 * | 1/2003 | Springer | 33/265 |
| 6,560,884 | B1 * | 5/2003 | Afshari | 33/265 |
| 6,601,308 | B1 | 8/2003 | Khoshnood | 33/265 |
| 6,651,350 | B1 * | 11/2003 | Manns et al. | 33/265 |
| 6,892,462 | B1 | 5/2005 | Rager | 33/265 |
| 6,925,721 | B1 * | 8/2005 | Dietz | 33/265 |
| 6,938,349 | B1 * | 9/2005 | Afshari | 33/265 |
| 2004/0111900 | A1 | 6/2004 | Rager | 33/265 |

OTHER PUBLICATIONS

Bow sight from HHA Sports. (One page description with 6 photographs), Jun. 2000.

Bow sight from Tru-Glo, Inc., including Affidavit of David Stroh with 2 photographs, Jun. 2000.

"Trophy Ridge Flatliner", Bow Hunting World, Aug. 2001, p. 14.

"Trophy Ridge Chris Rager True Innovator", Bill and Sherry Krenz, Inside Archery, Mar. 2003, pp. 42-44 and 46-53.

"Defendants' Consolidated Answer, Counterclaims and Jury Demand", served Sep. 1, 2005 in Civil Action No. CV-03-10-BU-CSO.

"Defendants' Motion for Leave to File Consolidated Answer, Counterclaims and Jury Demand and Brief in Support" (including Exhibit A), served Sep. 1, 2005 in Civil Action No. CV-03-10-BU-CSO.

"Trophy Ridge Flatliner", Bow Hunting World, Aug. 2001, p. 14.

"Bow Sights 2002", Richard Combs, Archery Business, Mar./Apr. 2002, pp. 54-59.

"Tried and True, Better Hunting Sights", Bill Krenz, Bowhunter, Oct./Nov. 2002, pp. 60, 64, 66 and 68.

"Trophy Ridge Chris Rager True Innovator", Bill and Sherry Krenz, Inside Archery, Mar. 2003, pp. 42-44 and 46-53.

"Defendants' Consolidated Answer, Counterclaims and Jury Demand", served Sep. 1, 2005 in Civil Action No. CV-03-10-BU-CSO.

"Defendants' Motion for Leave to File Consolidated Answer, Counterclaims and Jury Demand and Brief in Support" (including Exhibit A), served Sep. 1, 2005 in Civil Action No. CV-03-10-BU-CSO.

"Communication Regarding Trophy Ridge, LLC's Offer for Sale of the Flatliner and Matrix Sights", filed with U.S. Patent and Trademark Office Sep. 14, 2005 relating to U.S. Appl. No. 10/406,733.

"Communication Regarding Information from Litigation", filed with U.S. Patent and Trademark Office Sep. 14, 2005 relating to U.S. Appl. No. 10/406,733.

* cited by examiner

*Fig. 9*
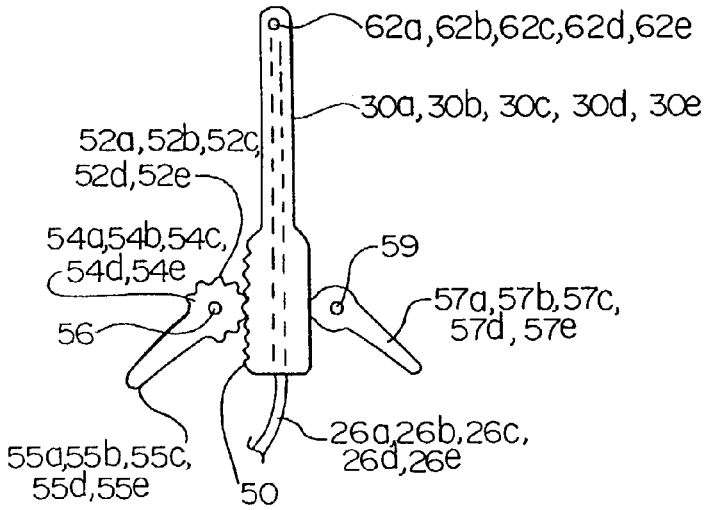
*Fig. 10a* *Fig. 10b* *Fig. 10c* *Fig. 10d*
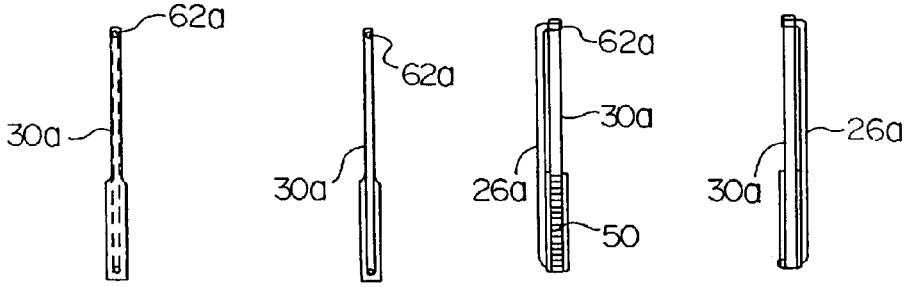

BOW SIGHT HAVING VERTICAL, IN-LINE SIGHT PINS, AND METHODS

This application is a continuation-in-part application of U.S. patent application Ser. No. 10/196,333 filed Jul. 16, 2002 U.S. Pat. No. 6,892,462, which is a continuation application of U.S. patent application Ser. No. 09/607,243, filed Jun. 30, 2000, now U.S. Pat. No. 6,418,633.

FIELD OF THE INVENTION

The invention relates to a sight. In particular, the sight includes pins having a vertical portion, the pins defining sight points.

BACKGROUND OF THE INVENTION

This invention relates generally to archery equipment and more particularly to a sighting apparatus for use with an archery bow.

Bow sights generally have multiple sight points, used when shooting arrows at targets positioned at different distances from the archer. Many bow sights include multiple sight points attached to horizontal pins. Bow sights with horizontal pins are shown, for example, in U.S. Pat. Nos. 5,103,568; 5,676,122; and 5,685,081.

A number of U.S. patents disclose bow sights having various other arrangements of sighting points. See, for example, U.S. Pat. Nos. 3,234,651; 4,120,096; 5,086,567; and 5,131,153.

SUMMARY OF THE INVENTION

The invention is directed to a sight having at least two vertical pins, each of the pins defining a sight point. When viewed by the archer in a shooting position, the pins are vertically aligned.

In one aspect, the invention is to a bow sight having at least two pins, each of the pins having a vertical portion, with the vertical portions of the two pins being aligned when viewed by the archer in a shooting position. Each of the pins defines a sight point. The bow sight has a support structure to which the pins are connected, and the support structure includes a mounting base for attaching the sight to a bow.

In another aspect, the invention is to a bow sight having a mounting base configured for attachment to a bow, a support structure movably connected to the mounting base, and a first pin, a second pin, and a third pin adjustably connected to the support structure. Each of the first, second and third pins has a first end connected via an attachment point to its support structure; and a second end proximate a sight point. The first pin, the second pin, and the third pin are vertically aligned when the bow sight is in a first position and viewed by the archer holding the bow in a shooting position. The pins can extend upward or downward from the support structure.

The first position and the second position can be 90 degrees apart. The support structure may be rotationally connected to the mounting base, or be removably connected.

In another aspect of the invention, a bow sight is provided having a mounting base configured for attachment to a bow, and a support structure releasably connected to the mounting base, the support structure having a first mounting region and a second mounting region, each of the first and second mounting regions configured for connection to the mounting base. A pin is connected to the support structure, the pin having a first end connected to the support structure at an attachment point, and a second end defining a sight point. When the support structure is connected to the mounting base via the first mounting region, the bow sight is in a first position and the pin is in a first position, and when the support structure is connected to the mounting base via the second mounting region, the bow sight is in a second position and the pin is in a second position which is different than the first position. The first mounting region can be approximately 90 degrees from the second mounting position, and when the pin is in the first position, the pin can extend vertically, and when the pin is in the second position, the pin can extend horizontally. Second and third pins can be included, as can an alignment system for each or any of the pins.

In yet another aspect, the invention is to a bow sight having a mounting base configured for attachment to a bow, a support structure movably connected to the base, the support structure movable from a first position to a second position, and first and second pins connected to the support structure. The first second pins extend vertically and are aligned when the support structure is in a first position, and the first and second pins extend horizontally when the support structure is in a second position.

It is understood that these features described above can be combined in any manner to provide a bow sight in accordance with this disclosure.

BRIEF DESCRIPTION OF THE DRAWINGS

FIG. 9 is an exploded view of a vertical pin, an associated adjustment knob and an associated cam member according to the principles of the present invention.

FIG. 10*a* is a rear view of a vertical pin according to the principles of the present invention.

FIG. 10*b* is a front view of the vertical pin of FIG. 10*a*.

FIG. 10*c* is a left view of the vertical pin of FIG. 10*a*.

FIG. 10*d* is a right view of the vertical pin of FIG. 10*a*.

DETAILED DESCRIPTION OF A PREFERRED EMBODIMENT

Figure 1:
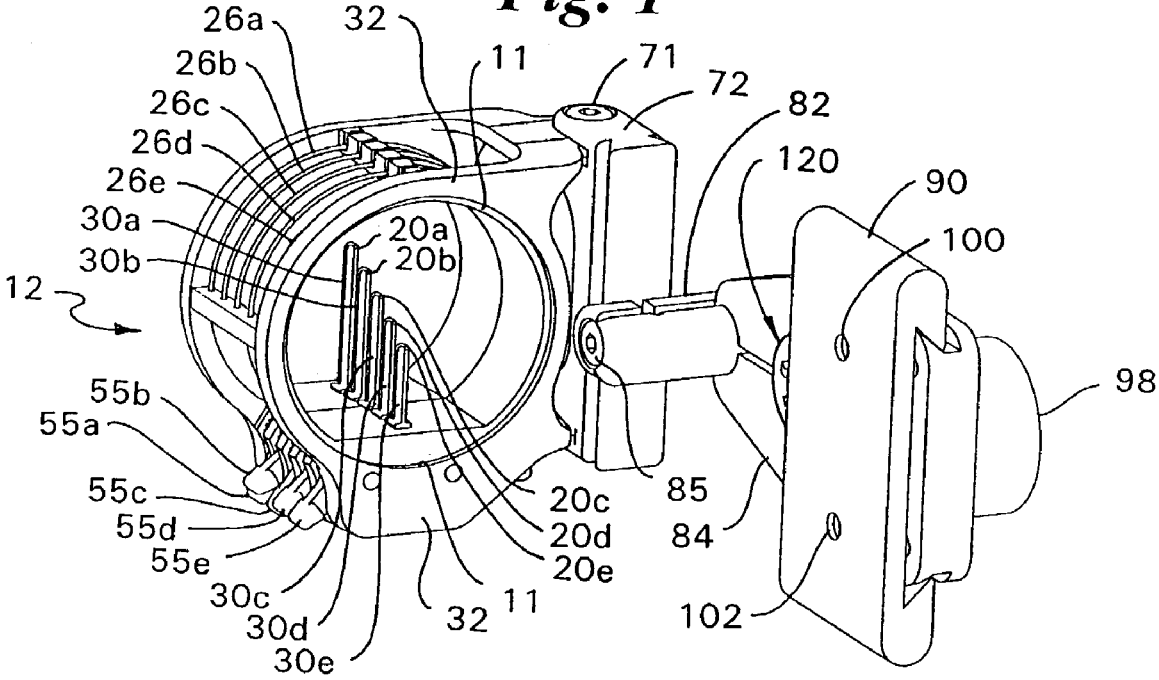
FIG. 1 is a perspective view of a bow sight according to the principles of the present invention.
Figure 2:
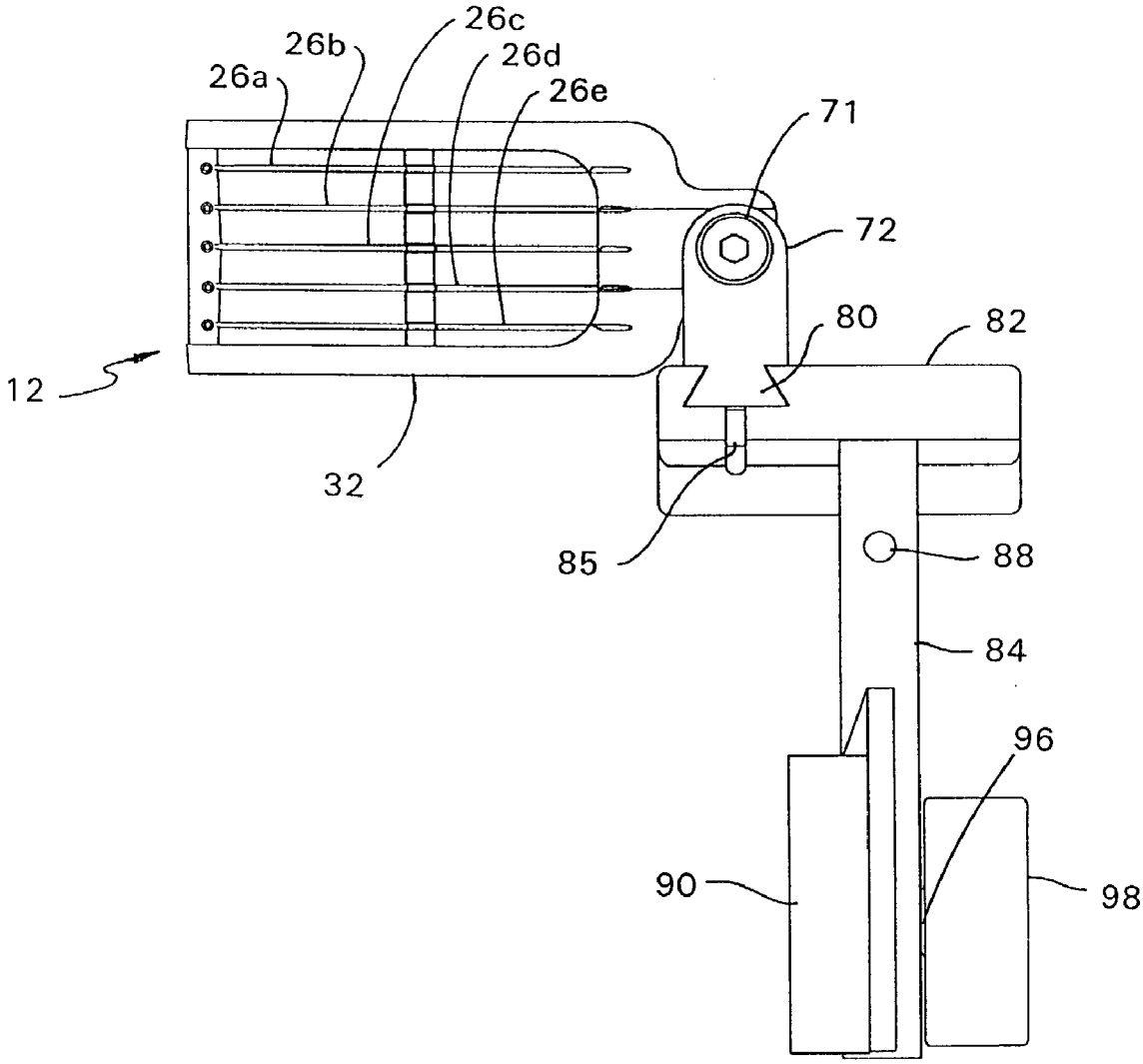
FIG. 2 is a top view of the bow sight of FIG. 1.

In the following description of various embodiments, reference is made to the accompanying drawings which form a part hereof, and in which is shown by way of illustration specific embodiments in which the invention may be practiced. It is to be understood that other embodiments may be utilized and structural changes may be made without departing from the scope of the present invention.

A bow sight is a device that is attachable to an archery bow, such as a compound bow or a cross-bow, and which provides one or more sight points to facilitate targeting by the archer. The archer uses a selected sight point to aim, and shoot, at a desired target. A peep sight may be placed on the string of the bow such that the archer can sight through the peep sight and at the sight point with the target in the background. For purposes of this application, the view of the bow sight as seen from the archer in the shooting position is referred to as the front view of the bow sight.

A first preferred embodiment of a bow sight 12 is illustrated in FIGS. 1–7. Bow sight 12 includes a support structure 32, a plurality of pins 30*a*, 30*b*, 30*c*, 30*d*, 30*e* (30*a*–*e*) having a vertical portion, and a plurality of sight points 20*a*, 20*b*, 20*c*, 20*d*, 20*e* (20*a*–*e*). Although five pins and their respective sight points are illustrated, it is understood that any number of pins and sight points can be utilized. However, in most embodiments, at least two pins will be present.

A support structure is any suitable structural member or members that support(s) the pins and sight points. Typically, the support structure includes or has a mounting base for attaching bow sight 12 to a bow. In a preferred embodiment, support structure 32 is a generally circular shaped piece of material, such as acrylic, polycarbonate, or other plastic, aluminum, or the like, that supports the vertical pins 30*a*–*e* which support the sight points 20*a*–*e* respectively. Other examples of suitable support structure shapes include square, elliptical, and oblong. The support structure may be composed of multiple sections or pieces that together form the support structure. It is preferred that the support structure encompasses and encircles pins 30*a*–*e* at least partially, so that pins 30*a*–*e* are positioned within support structure 32. A circular or other annular shape of support structure 32 provides protection of the vertical pins 30*a*–*e* from being damaged or bent while also providing a good view of the ultimate target through the interior portion of the circular support structure.

As stated above, bow sight 12 has vertical pins 30*a*–*e*. A vertical pin is an elongate member having a vertically elongated portion. A vertical pin could include features in addition to the fact that it has a length that is vertical. For example, a vertical pin could be an L-shaped pin with the horizontal portion of the L-shape extending in the direction toward the archer in the shooting position. See FIG. 8 for an example of an L-shaped pin that falls within the definition of a vertical pin. Vertical pins have a significant advantage over horizontal pins because the field of view to the right and left of the vertical pins, when viewed by the archer in the shooting position, is very open for viewing the target and the environment of the target area.

The pin supports or otherwise defines a sight point, which the archer uses for targeting an object. The sight point may be integral with the pin or be a separate piece from the vertical pin.

A sight or sighting point is any shape, point, or indicia of any sort that is visually placed in line with the target to be shot at for assisting in the proper aiming of the bow. Sight points can be circular shapes, other geometrical shapes, colored dots, the end of a light gathering cable, or simply the end of a sight pin, for example.

In the illustrated embodiment, the sight points 20*a*–*e* are formed by the ends of the fiber optic cables 26*a*–*e*. The fiber optic cables 26*a*–*e* collect light along their lengths, and the light exits the end of the cables 26*a*–*e* forming the sight points. In this preferred embodiment, the ends of the fiber optic cables 26*a*–*e* are held in place by vertical pins 30*a*–*e*.

In a preferred embodiment, the vertical pins 30*a*–*e* are linear vertical pins that define a hole in the uppermost end for receiving the ends of the fiber optic cables 26*a*–*e*. In another preferred embodiment, the vertical pins are linear vertical pins that do not define a hole in the uppermost end. In this embodiment, the ends of the fiber optic cables 26*a*–*e* are glued or crimped to the ends of the vertical pins 30*a*–*e*.

FIGS. 10*a*–*d* show a preferred embodiment of a vertical pin 30*a* from the rear, front, left and right views respectively. The fiber optic cable 26*a* can also be seen in its relationship to the vertical pin 30*a*.

The point at which a vertical pin is attached to a support structure is the attachment point. Vertical pins can be attached to the support structure in many different orientations. Vertical pins can be attached to the support structure with the sight point below the attachment point or with the sight point above the attachment point. It is also within the scope of the present invention to have a bow sight with one or more vertical pins attached to the support structure with the sight point below the attachment point and one or more vertical pins attached to the support structure with the sight point above the attachment point.

It is often desired to adjust the sight point height associated with a particular vertical pin. These adjustments are made to "sight-in" the bow so that each sight point is accurately associated with a target of a particular distance. A vertical pin is "vertically adjustable" when the associated sight point for that vertical pin can be moved vertically up or down.

In a preferred embodiment, each of the vertical pins 30*a*–*e* is vertically adjustable by movement of the entire vertical pin, which can be accomplished by a system of gears on the pins and on knobs. Each of the vertical pins 30*a*–*e* include gears or teeth, such as gears 50 on vertical pins 30*a*–*e* as shown in FIG. 9. Gears 50 are also shown in FIG. 10*c*. These gears 50 are adapted to interact with corresponding gears on a counter surface. Adjustment knobs 54*a*, 54*b*, 54*c*, 4*d*, 54*e* (54*a*–*e*), one for each pin 30*a*–*e*, each include gears 52 that are constructed to engage gears 50. The gears 50 on vertical pins 30*a*–*e* interact respectively with the gears 52 on the adjustment knobs 54*a*–*e* such that rotation of an adjustment knob results in linear vertical motion of the respective vertical pin. The adjustment knobs 54*a*–*e* also include levers 55*a*–*e*, respectively, which are integral with the corresponding adjustment knob 54*a*–*e*. The lever makes it easier to rotate the adjustment knob.

Figure 6:
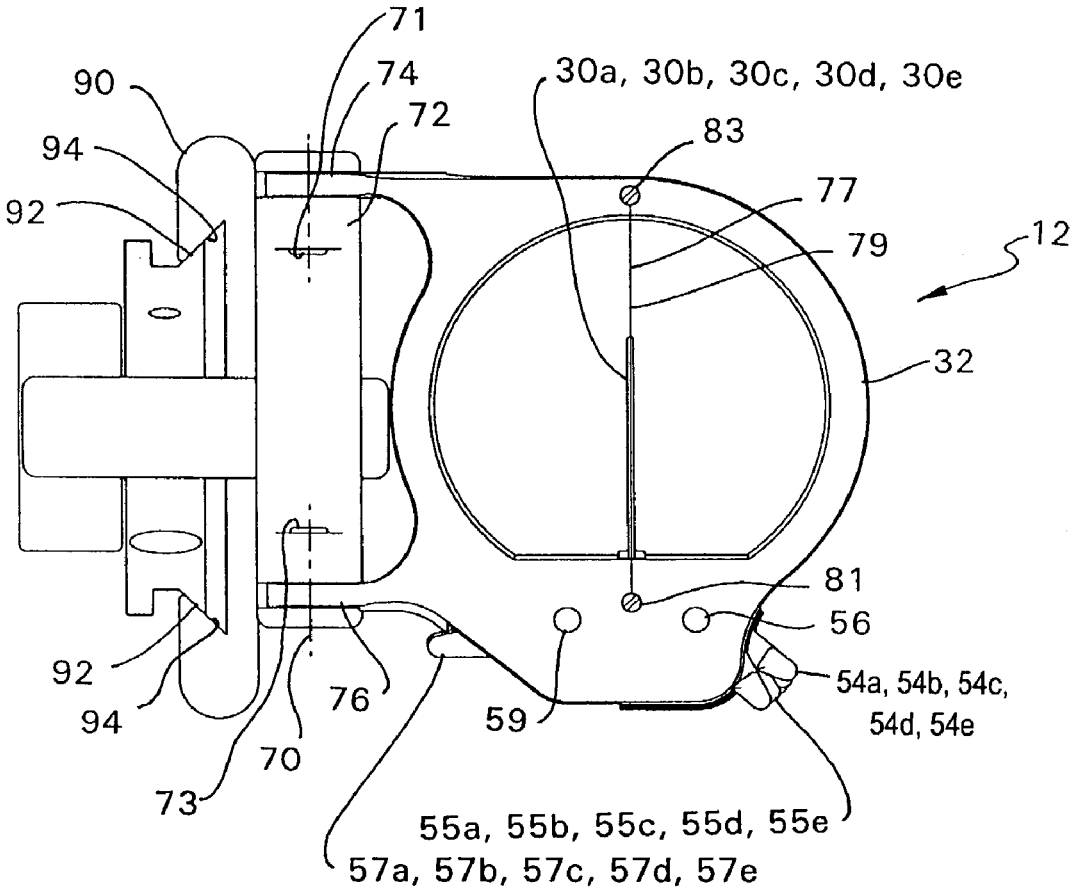
FIG. 6 is a back view of the bow sight of FIG. 1 and illustrating a bow torque indicator.

Referring to FIGS. 6 and 9, an axis rod 56 extends through the center axis of the adjustment knobs 54*a*–*e*. Facilitated by levers 55*a*–*e*, the adjustment knobs 54*a*–*e* rotate around the axis rod 56.

This vertically adjustable pin system includes cam members 57*a*–*e* which allow the archer to lock the vertical position of each vertical pin 30*a*–*e* as desired. The cam members 57*a*–*e* rotate about an axis rod 59. Rotation of a cam member 57*a*–*e* results in engagement or disengagement of the respective cam member 57*a*–*c* with the pin 30*a*–*e*, preferably the side of the vertical pin opposite the gears 50. This camming action allows the archer to prevent the vertical pins from moving once their vertical height is properly set.

In order to adjust the vertical position of a pin, the archer disengages the corresponding cam member from the pin, makes an adjustment of the vertical height of the pin by rotating or otherwise moving the adjustment lever, and then moves the cam member back into engagement with the vertical pin to hold its new vertical position. Once each pin is adjusted to the proper vertical position, cam members 57*a–e* inhibit rotation of the adjustment knobs 54*a–e* and thus vertical movement of pins 30*a–e*.

Other means for preventing rotation of the adjustment knobs are contemplated. For example, a screw could be used in place of cam members 57*a–e*. Such screws (not shown) would extend perpendicular to the vertical pins and would extend through a hole in the support structure 32. Tightening of the screw associated with the vertical pin 30*a*, for example, would secure the vertical position of the sight point on vertical pin 30*a*. To adjust the height of vertical pin 30*a*, the associated screw is loosened and the adjustment knob 55*a* rotated. Additionally, other methods for adjusting the height of pins 30*a–e* are contemplated. For example, pins 30*a–e* could be manually raised and lowered, rather than via gears.

As discussed above, in a preferred embodiment of the invention, the end of a light gathering cable is used as the sight point, at the end of or close to the end of a vertical pin. A light gathering cable is any cable that collects light along the perimeter of its length and projects the light out the end of the cable; an example of a light gathering cable is a fiber optic cable.

Figure 7:
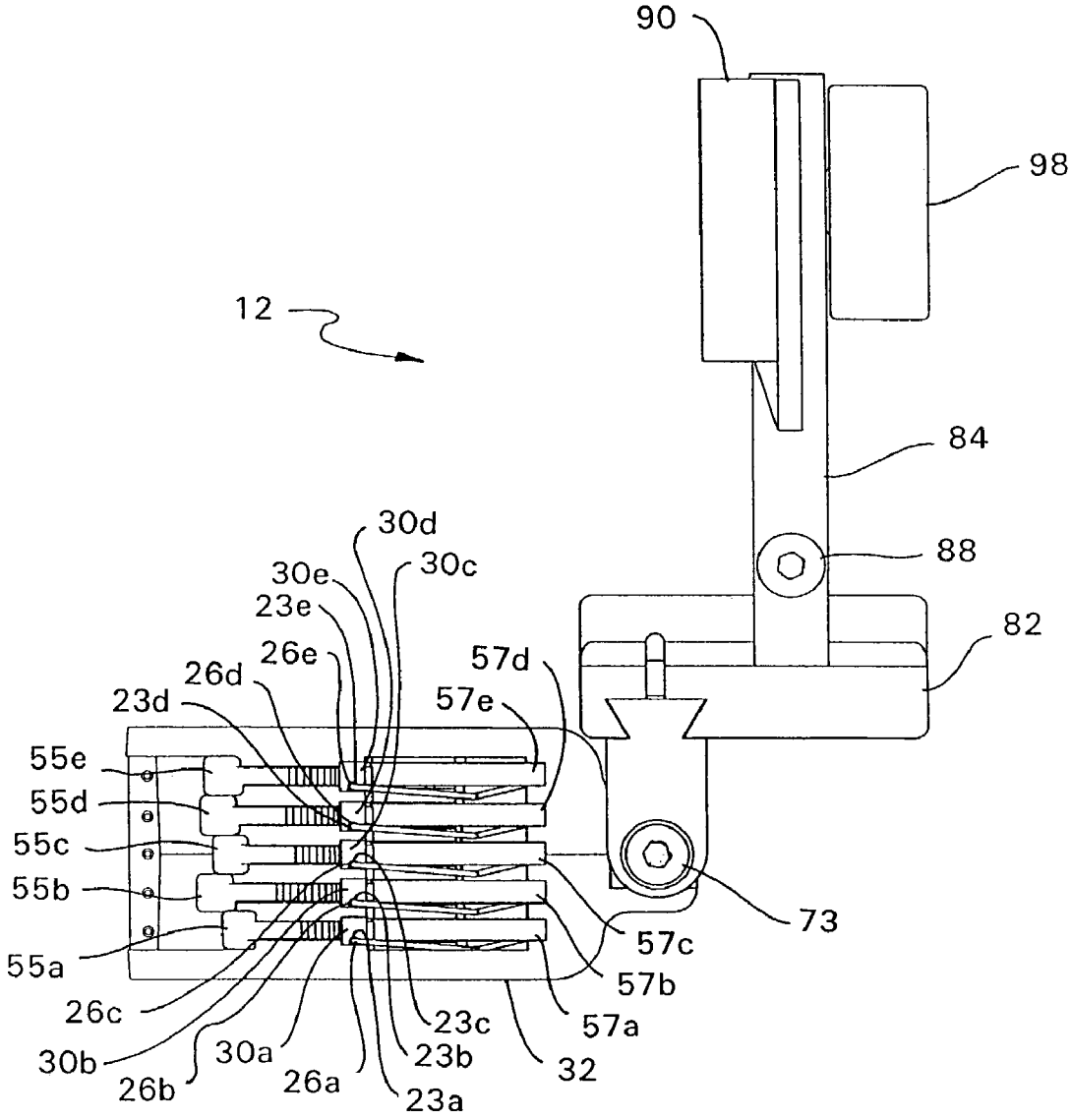
FIG. 7 is a bottom view of the bow sight of FIG. 1.

Fiber optic cables 26*a–e* are mounted around the perimeter of the support structure 32 as shown in FIGS. 1, 2, 4, 5 and 7. As illustrated in FIG. 7, the fiber optic cables 26*a–e* extend within grooves 23*a–e* in the vertical pins 30*a–e*. The fiber optic cables are bent as needed, typically 45–90 degrees, so that the end of the cables passes through holes 62*a–e* present near the end of the vertical pins 30*a–e*. The ends of the fiber optic cables 26*a–e* form the sight points.

In a preferred embodiment of the bow sight of the invention, the vertical pins, pin height adjustment levers, cam lock mechanisms and the support structure are made of acrylic plastic. It should be appreciated, however, that this invention is not limited by the type of material used for its parts. Many alternative materials can be used. For example, in an alternative embodiment these parts could be made of aluminum or any other material that can structurally perform the functions of these parts.

Figure 8:
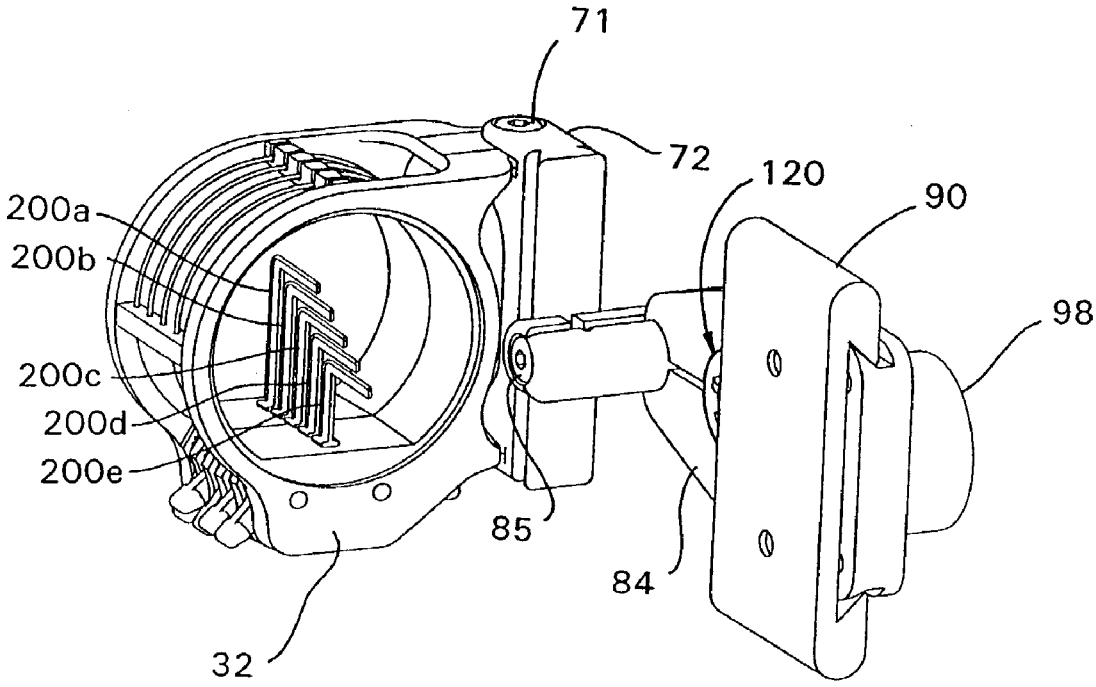
FIG. 8 is a perspective view of a second embodiment of a bow sight according to the principles of the present invention.

FIG. 8 is a perspective view of an alternative embodiment of a bow sight according to the invention. The difference between the embodiment of FIG. 1 and of FIG. 8 is that the vertical pins 200*a–e* in FIG. 8 are L-shaped. That is, the vertical pins 200*a–e* have a vertical portion and also a horizontal portion. The horizontal portion extends in the direction towards the archer when the archer is standing in the shooting position. The sight points associated respectively with the vertical pins 200*a–e* are all in the same vertical plane as the pins.

It is also noted that in an alternative preferred embodiment, the pins within the support structure are protected by a circular and planar piece of non-opaque plexiglass or other suitable material, such as polycarbonate. The protector material (not shown) fits within the rim 11 of the support structure 32 (see FIG. 1). A similar piece of protector material may be placed on the back side of the support structure 32. It is understood that the plexiglass or other material used to protect the pins would preferably be shaped to correspond to the shape of support structure 32.

The present invention also provides a bow sight having a torque adjustment feature. It is well recognized that each archer tends to hold a bow differently than he next. Some archers tend to torque the bow one way or another in the horizontal plane while shooting an arrow. Such bow torque removes the vertical pins 30*a–e* from alignment and causes inaccurate shooting.

It is important that vertical alignment of the vertical pins be accomplished so that accuracy in shooting the bow with the bow sight can be achieved. Two vertical pins are "vertically aligned" when they are in a single vertical line as viewed from the position of the archer while holding the bow in the shooting position (with the string drawn). Vertical pins that do not form a single line as viewed from the archer, but that through an adjustment can be brought into a single line from the view of the archer still fall within the definition of "vertically aligned".

In a preferred embodiment, all five vertical pins 26*a–e* are vertically aligned. While the vertical pins 26*a–e* may not initially form a single line as viewed by the archer in the shooting position, the pins can be adjusted to bring the five pins 26*a–e* into a single line as viewed from the archer in the shooting position, as will be described below. The present invention provides an adjustment system to compensate for bow torque.

Referring to FIG. 6, a bow torque indicator 77 is also illustrated present on bow sight 12. A bow torque indicator is any vertical member that indicates to the archer whether there is torque present. In the embodiment of FIG. 6, the bow torque indicator 77 is a vertical wire 79 situated behind the vertical pins 30*a–e*. In a preferred embodiment, the vertical wire 79 is aircraft cable with a diameter of 0.030 inches. The vertical wire 79 is attached to the support structure by screws 81 and 83.

If the bow is not being held straight, that is, torque is being applied to the bow, prior to adjustment, the archer will see that the vertical pins 30*a–e* are not lined up in a single vertical line with the bow torque indicating wire 79. The archer will then know that bow torque adjustment is required.

The bow torque adjustment system is embodied in the ability to rotate the support structure 32 about an axis 70. This bow torque adjustment system compensates for the torque to ensure vertical alignment of the vertical pins 30*a–e*. By rotating the support structure 32 around the axis 70, an archer can set the bow sight 12 such that when that archer shoots, the vertical pins 30*a–e* all appear in a single line as viewed from the archer when shooting the bow.

The torque adjustment system of sight 12 includes an upper sleeved arm 74 and a lower sleeved arm 76. A sleeve member 72 is rotationally connected to the support structure 32 along axis 70 by a first torque adjustment screw 71 and a second torque adjustment screw 73, both which extend linearly along the axis 70. An archer can loosen torque adjustment screws 71, 73 with an Allen wrench (or by other means depending on the type of screw used) and then make the rotational adjustment between the sleeve member 72 and the support structure 32 as is necessary to bring the vertical pins 30*a–e* into vertical alignment as viewed from the shooting position. Once the correct rotational position is achieved, torque adjustment screws 71, 73 are tightened to prevent the sleeve member 72 and support structure 32 from rotating relative to one another.

The attachment of sleeve member 72 and support structure 32 to the bow is now described. The sleeve member 72 includes a double dove tail portion 80 that is received by a double dove tail recess in horizontal bar 82. A screw 85 allows for tightening and loosening of the sliding interaction between the double dove tail 80 and the double dove tail recess in the horizontal bar 82. The vertical position of sleeve member 72 can therefore be adjusted relative to horizontal bar 82. The horizontal bar 82 is received by an extender member 84 that has one end with an adjustable jaw 86 for holding and supporting horizontal bar 82. The jaw 86 is adjustable via screw 88. Thus, the position of horizontal bar 82 can be adjusted horizontally, as viewed from the archer in the shooting position.

The extender member 84 is releasably and adjustably connected to base 90. Extender 84 has a double dove tail 92 that is received by the double dove tail recess 94 of base 90. Therefore, extender 84 is slidably received by base 90 such that base 90 and extender 84 can be horizontally moved relative to one another toward and away from the archer.

Figure 3:
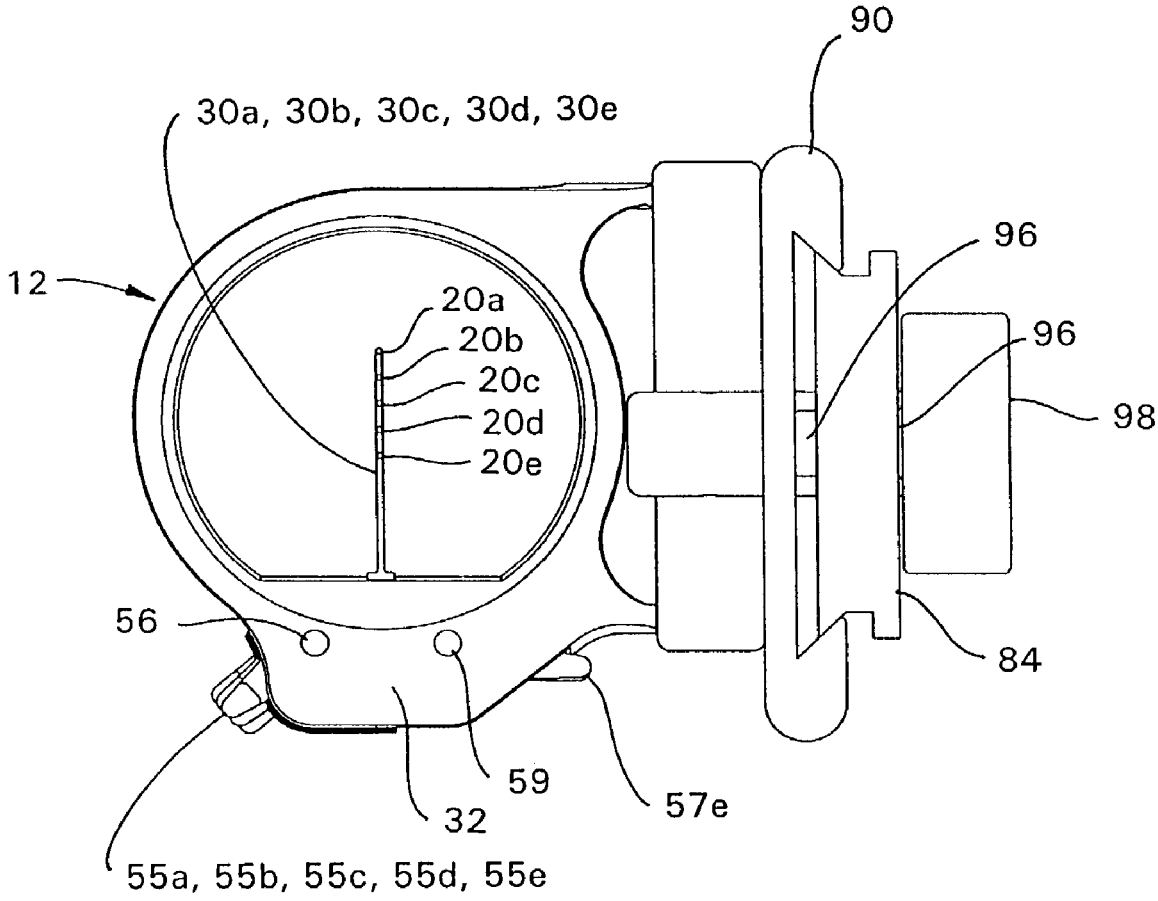
FIG. 3 is a front view of the bow sight of FIG. 1.

Referring now to FIG. 3, once the desired position of extender 84 relative to base 90 is determined, extender 84 is secured to base 90 by screw 96 and adjustment knob 98. By tightening adjustment knob 98, the screw 96 extends into a small recess (not shown) in base 90 to prevent movement between extender 84 and base 90. The base 90 is secured to the bow with two screws that pass through holes 100 and 102 and into the bow (see FIG. 5).

In a preferred embodiment, sleeve member 72, horizontal bar 82, extender 84, base 90, and adjustment knob 98 are made of aluminum.

During shooting of the bow, when the string on the bow is released, a significant vibration is created. In order to enhance performance of the bow, it is desired to reduce these vibrations. In another aspect of the invention, dampeners are provided on the bow site. A dampener includes at least some material that is softer than the material that makes up the part of the bow sight to which the device is directly attached, such that the device at least partially absorbs the vibrations caused by the release of the bow string when shooting an arrow. Dampeners may be placed in the support structure itself or in any of the various members that connect the support structure to the bow.

Figure 4:
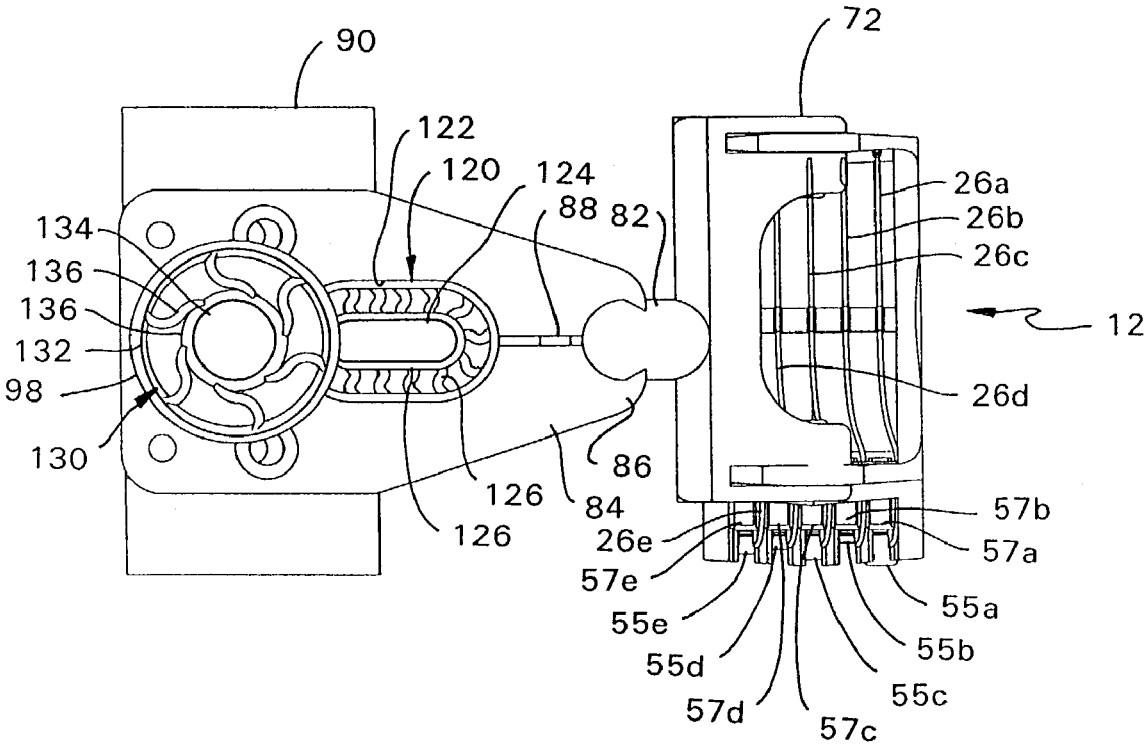
FIG. 4 is a right side view of the bow sight of FIG. 1.
Figure 5:
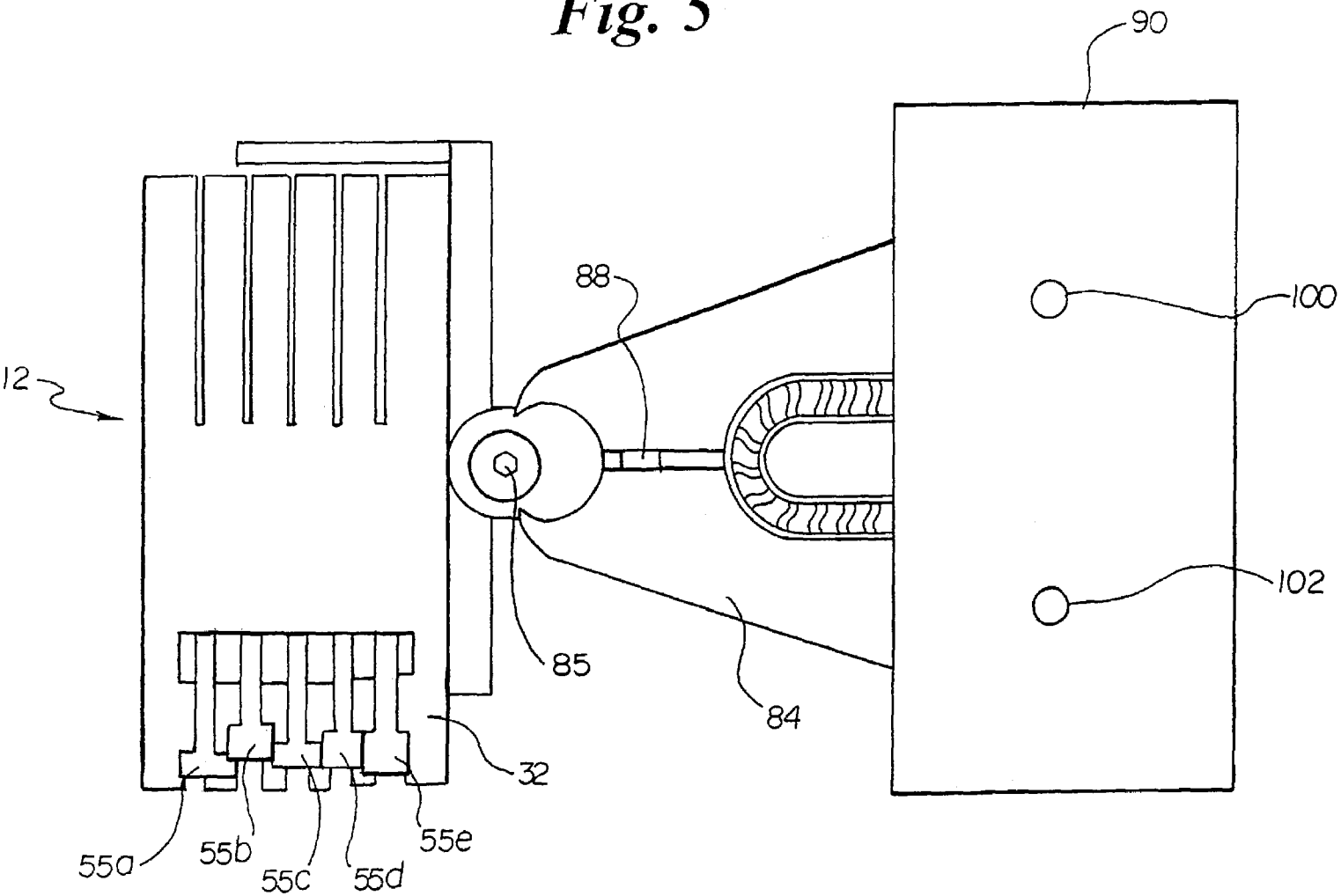
FIG. 5 is a left side view of the bow sight of FIG. 1.

Referring to FIG. 4, a dampener 120 is secured in a recess 122 in the extender 84. The recess 122 and dampener 120 are oval in shape but could be any shape. The dampener 120 comprises a brass core 124 surrounded by a webbed rubber member 126 around the perimeter of the brass core 124. Alternate materials can certainly be used for the dampener. For example, the core could be aluminum with an outer perimeter material of plastic.

Also shown in FIG. 4, a second dampener 130 is secured in a recess 132 in the adjustment knob 98. The dampener 130 and recess 132 in this embodiment are circular in shape but again could be any shape. The dampener 130 includes a brass core 134 and a webbed rubber member 136 around the perimeter of the brass core 134.

While particular positions of the dampeners 120, 130 connected to the support structure 32 have been provided in the drawings, it is noted that dampeners may be connected to the support structure 32 in many different locations. For example, a dampener could be set in a recess (not shown) in the support structure 32.

Variations of pin configurations are illustrated in FIGS. 11, 12 and 13*a* and 13*b*. In each of these three embodiments, the pins include a vertical portion and a portion which is not vertical, for example, a non-vertical portion which is horizontal.

Figure 11:
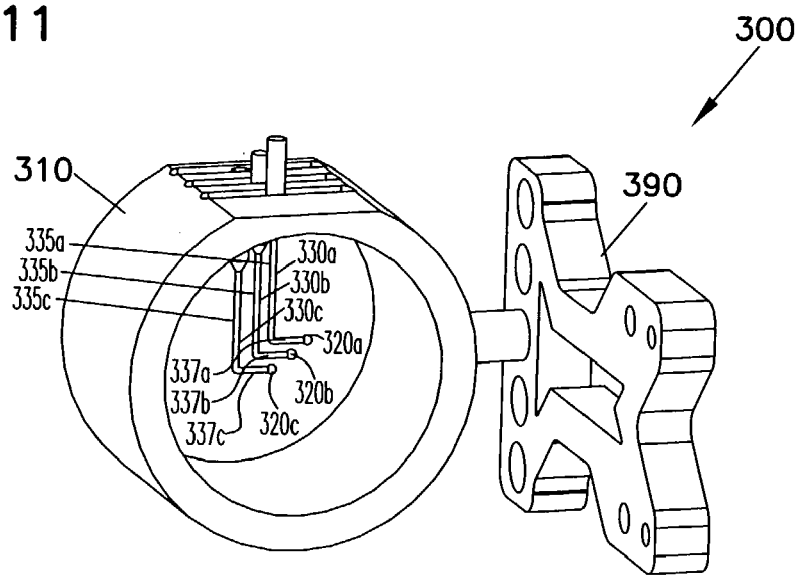
FIG. 11 is a front perspective of a further embodiment of a bow sight according to the principles of the invention.

Referring to FIG. 11, a bow sight 300 having a support structure 310 and mounting base 390 is shown. Support structure 310 includes within it pins 330*a*, 330*b*, 330*c*, each pin having a sight point 320*a*, 320*b*, 320*c*, respectively. Each of pins 330*a–c* includes a vertical portion 335*a*, 335*b*, 335*c*, and a non-vertical portion 337*a*, 337*b*, 337*c*. In this embodiment, the vertical portion extends from the attachment point of pins 330*a–c* to support structure 310, and non-vertical portions are proximate sight points 320*a–c*. When viewed by the archer in the shooting position, vertical portions 335*a–c* are aligned. The non-vertical portions 337*a–c* of pins 330*a–c* extend horizontally and provide spaced sight points 320*a–c*.

Figure 12:
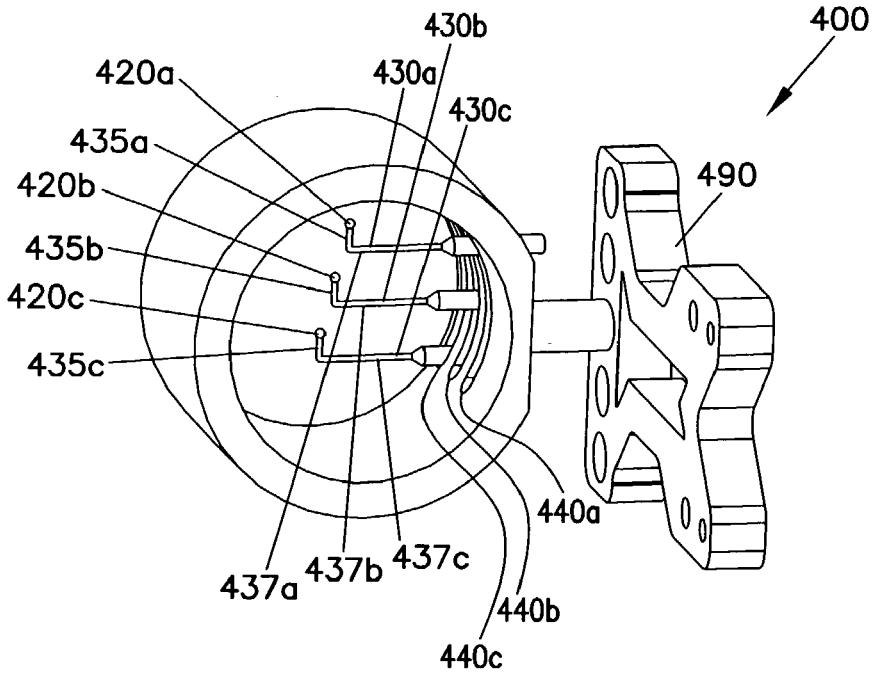
FIG. 12 is a front perspective of yet a further embodiment of a bow sight according to the principles of the invention.

A variation is shown in FIG. 12, a bow sight 400 having a support structure 410 and mounting base 490 is shown. Support structure 410 includes within it pins 430*a*, 430*b*, 430*c*, each pin having a sight point 420*a*, 420*b*, 420*c*, respectively. Each of pins 430*a–c* includes a vertical portion 435*a*, 435*b*, 435*c*, respectively, and a non-vertical portion 437*a*, 437*b*, 437*c*. In this embodiment, the vertical portion is proximate sight points 420*a–c*. As illustrated in FIG. 12, vertical portions 435*a–c* do not overlap one another, that is, pins 430*a–c* are sufficiently spaced so that a first vertical portion (e.g., 435*a*) does not overlap with a second vertical portion (e.g., 435*b*). Pins 430*a–c* could be vertically adjustable, for example via slots 440*a–c*, so that the vertical portions do overlap. Alternately, vertical portions 435*a–c* could be longer so that they overlap. Preferably, when the vertical portions do overlap, when viewed by the archer in the shooting position, vertical portions 435*a–c* are aligned.

Figure 13A:
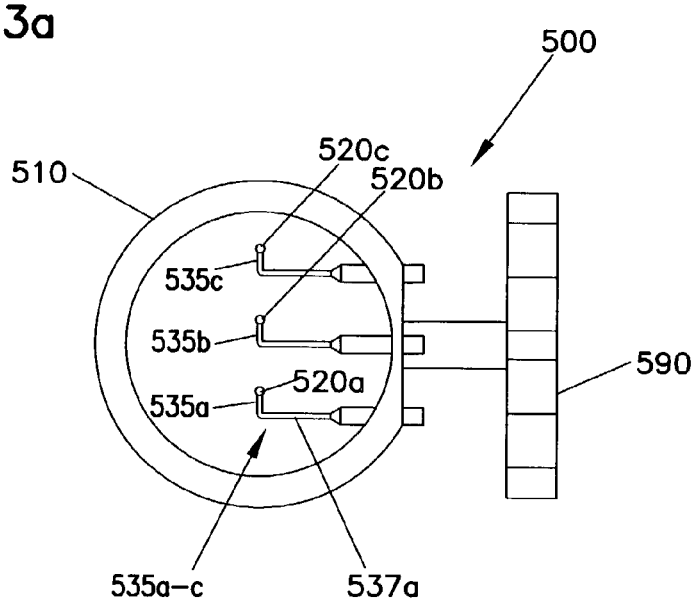
FIG. 13*a* is a front view of still a further embodiment of a bow sight according to the principles of the invention.
Figure 13B:
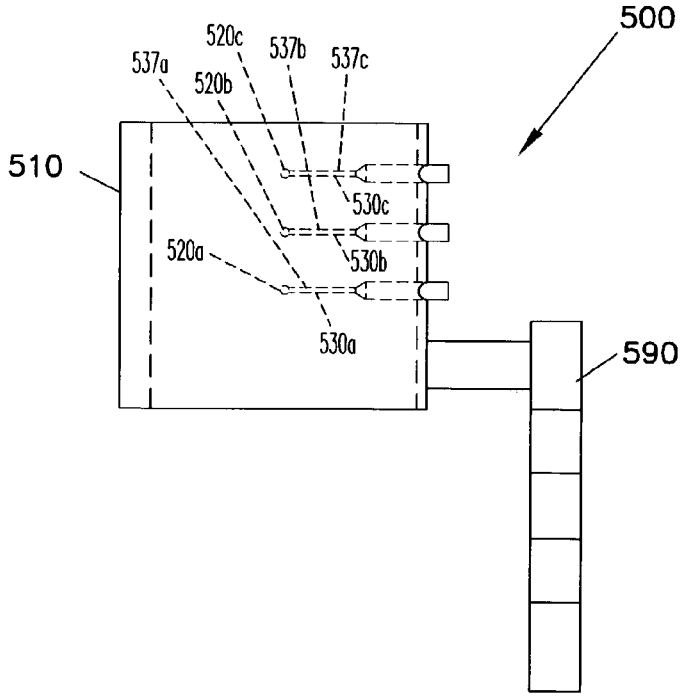
FIG. 13*b* is a top view of the bow sight of FIG. 13*a*.

Still another variation is shown in FIGS. 13*a* and 13*b*, as bow sight 500. Bow sight 500 has support structure 510 and base 590. Pins 530*a*, 530*b*, 530*c* are attached to support structure 510. Each of pins 530*a–c* has a vertical portion 535*a*, 535*b*, 535*c* and a horizontal portion 537*a*, 537*b*, 537*c*. Pins 530*a–c* define sight points 520*a*, 520*b*, 520*c*. When viewed by the archer in the shooting position, horizontal portions 537*a–c* are aligned, so only one horizontal portion, 537*a*, is visible. Similarly, vertical portions 535*a–c* are aligned, so that they overlap at least partially. Each vertical portion 535*a–c* has a different length, thus, so when horizontal portions 537*a–c* are aligned, each sight point 520*a–c* is individually visible. It may be desirable to vertically adjust the heights of pins 530*a–c*, for example, via slots, as shown in FIGS. 11 and 12 with bow sights 300 and 400. Movement of pins 530*a–c* vertically may affect alignment of the horizontal portions of the pins.

Figure 14:
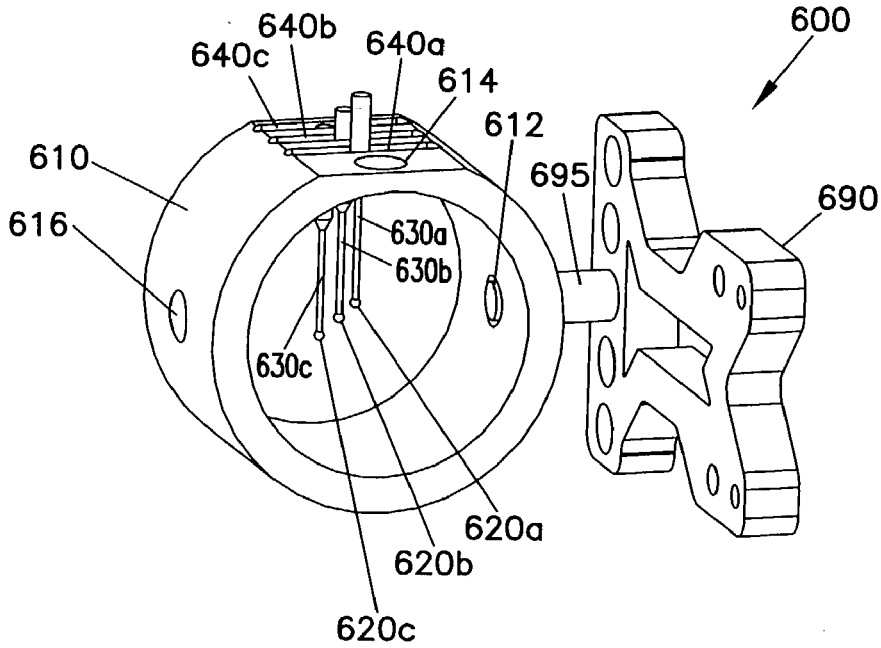
FIG. 14 is a front perspective view of yet another embodiment of a bow sight according to the principles of the invention, the bow sight in a first position.
Figure 15:
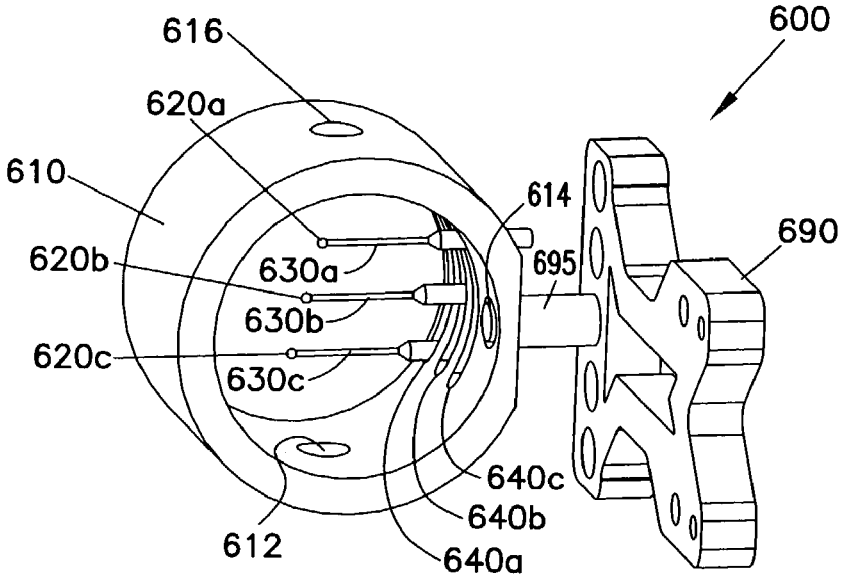
FIG. 15 is bow sight of FIG. 14 in a second position.

Yet another embodiment of the invention is illustrate in FIGS. 14 and 15. A bow sight 600 has a support structure 610 and includes pins 630*a*, 630*b*, 630*c*, each pin having a sight point 620*a*, 620*b*, 620*c*, respectively. Sight points 620*a–c* can be any sight point, including an end of a fiber optic cable. Support structure 610 is removably attached to mounting base 690; specifically support structure 610 is removably and replaceably attached to mounting base 690. Mounting base 690 is configured for attachment to or mounting on a bow.

Support structure 610 is removably attached to mounting base 690 via mounting regions such as apertures 612, 614 and 616 therein. Mounting apertures 612, 614, 616 are configured for attachment to mounting base 690, particularly, to arm 695 of base 690. In FIG. 14, support structure 610 is in a first position, with arm 695 engaged with aperture 612. In FIG. 15, support structure 610 is in a second position, with arm 695 engaged with apertures 614. It can be seen that support could also be placed in a third position, with arm 695 engaging aperture 616. Apertures 612, 614, 616 are positioned 90 degrees apart on support structure 610, thus, support structure 610 can be positioned at 90 degree (or, quarter-turn) increments. Spacing other than 90 degrees could also be used. Additionally, support structure 610 could be rotationally attached to mounting base 690, rather than removably attached. For example, support structure 610 could have a sliding system around its perimeter, which allows support structure 610 to be rotated in respect to mounting base 690.

When in the first position, as illustrated in FIG. 14, pins 630*a*, 630*b*, 630*c* extend vertically. The sight points 620*a–c* of pins 630*a–c* are positioned below the attachment point of pins 630*a–c* to support structure 610. When in the second position, as illustrated in FIG. 15, pins 630*a*, 630*b*, 630*c* extend horizontally. The sight points 620*a–c* are positioned in generally the same horizontal plane as the attachment point of pins 630*a–c* to support structure 610. If turned into the third position, pins 630*a*, 630*b*, 630*c* would extend vertically, with sight points 620*a–c* positioned above the attachment point.

When pins 630*a–c* are vertically positioned, as when in the first and third positions, pins 630*a–c* are preferably aligned in a plane or in a single line, when viewed by the archer in a shooting position. However, when pins 630*a–c* are horizontally positioned, as when in the second position, pins 630*a–c* are not aligned in a single line, but are spaced so that the archer views individual pins when shooting. To accommodate the two pin positions, aligned and unaligned, support structure 610 includes a pin alignment system, such as slots 640*a*, 640*b*, 640*c* therein, one for each pin 630*a*, 630*b*, 630*c*. Each pin 630*a–c* is movable within slot 640*a–c*, to allow the pins to be moved from being aligned to unaligned, and vice versa. Additionally, the extension of pins 630*a–c* from support structure 610 (e.g., the height of pins 630*a–c*) can also be adjusted via slots 640*a–c*. The geared or camming systems described above, for moving and locking pins 630*a–c*, in addition to conventional systems for releasably securing pins 630*a–c* within slots 640*a–c*, can be used.

In some designs, one of pins 630*a–c* may be non-movably attached to support structure 610 and the other pins 630*a–c* are movable in respect to support structure 610 and the fixed pin.

It is noted that these slots 640*a–c* can be use achieve the same purpose as the torque adjustment feature described above, which utilized axis 70 for pivoting the support structure. Additionally, in some embodiments, it may be desired to use only a single pin, whether vertical or horizontal. Slots 640*a–c* can be constructed to allow for removal of pins 630*a–c* from sight 600.

This embodiment of the invention provides a bow sight that can be changed back and forth from a sight having a plurality of vertical pins to a sight having a plurality of horizontal pins, thus, allowing greater flexibility for the archer.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description but rather by the claims appended hereto.

What is claimed:

1. A bow sight comprising:

(a) a mounting base configured for attachment to a bow;

(b) a support structure movably connected to the mounting base;

(c) a first pin, a second pin, and a third pin adjustably connected to the support structure, each of the first, second and third pins comprising:

(i) a first end connected to the support structure at an attachment point; and (ii) a second end proximate a sight point; and wherein the support structure is mountable in first and second positions relative to the mounting base, the first, second and third pins extending vertically when the support structure is in the first position and the first, second and third pins extending horizontally when the support structure is in the second position.

2. The bow sight according to claim 1 further including a pin alignment system for at least two of the first pin, second pin and third pin.

3. The bow sight according to claim 2, wherein the pin alignment system comprises:

(a) a first slot within the support structure, the first slot receiving one of the first pin, second pin and third pin, and (b) a second slot within the support structure, the second slot receiving a second one of the first pin, second pin and third pin.

4. A bow sight comprising:

(a) a mounting base configured for attachment to a bow;

(b) a support structure movably connected to the base, the support structure movable from a first position to a second position;

(c) a first pin and a second pin connected to the support structure, each of the first and second pins having:

(i) a first end connected to the support structure at an attachment point;

(ii) a second end defining a sight point;

wherein the first pin and the second pin extend vertically and are aligned when the support structure is in a first position, and the first pin and the second pin extend horizontally when the support structure is in a second position.

5. The bow sight according to claim 4, wherein the support structure is removably connected to the base.

6. A bow sight comprising:

a mounting base configured for attachment to a bow;

a sight housing defining a sight window, the sight housing being mountable in first and second orientations relative to the mounting base;

a plurality of sighting members that project into the sight window, each of the sighting members having a corresponding sight point;

the sighting members extending laterally into the sight window and being adjustable up and down relative to one another when the sight housing is mounted in the first orientation relative to the mounting base; and the sighting members being positionable one behind the other and aligned along a single vertical plane when the sight housing is mounted in the second orientation relative to the mounting base, the sighting members also being adjustable up and down relative to one another when the sight housing is mounted in the second orientation.

7. The bow sight of claim 6, wherein the sight housing includes one or more parts.

8. The bow sight of claim 6, wherein the sighting members include pins.

9. The bow sight of claim 6, wherein the sight housing defines a plurality of generally parallel slots positioned one behind the other, and wherein the sighting members are mounted in the slots.

10. The bow sight of claim 9, wherein the slots have lengths that extend in a generally vertical direction when the sight housing is mounted in the first orientation relative to the mounting base, and that extend in a generally horizontal direction when the sight housing is mounted in the second orientation relative to the mounting base.

11. The bow sight of claim 10, wherein the sighting members are moved along the lengths of the slots to adjust the sighting members up and down relative to one another when the sight housing is in the first orientation relative to the mounting base, and wherein the sighting members are moved generally perpendicular relative to the lengths of the slots to adjust the sighting members up and down relative to one another when the sight housing is in the second orientation relative to the mounting base.

12. The bow sight of claim 11, wherein the sighting members include pins.

13. The bow sight of claim 6, wherein the sight window is generally circular.

14. The bow sight of claim 6, wherein the sight housing forms an enclosure for protecting the sighting members.

15. The bow sight of claim 11, wherein the sight window is generally circular.

16. A bow sight for a bow, the bow sight comprising:

a base configured for attachment to a bow;

a support structure mountable in first and second orientations relative to the base, the bow sight being a horizontal pin sight when the support structure is mounted in the first orientation relative to the base, and the bow sight being a vertical pin sight when the support structure is mounted in the second orientation relative to the base;

a plurality of sight pins carried by the support structure, each of the sight pins having a corresponding sight point;

the sight pins extending generally horizontally and being adjustable up and down relative to one another when the support structure is mounted in the first orientation relative to the base to set the sight points to correspond to different target distances; and the sight pins being positionable one behind the other and vertically aligned as viewed by an archer during shooting when the support structure is mounted in the second orientation relative to the base, the sight pins also being adjustable up and down relative to one another when the support structure is mounted in the second orientation to set the sight points to correspond to different target distances.

17. The bow sight of claim 16, wherein the support structure defines a plurality of generally parallel slots positioned one behind the other, and wherein the sight pins are mounted in the slots.

18. The bow sight of claim 17, wherein the slots have lengths that extend in a generally vertical direction when the support structure is mounted in the first orientation relative to the base, and that extend in a generally horizontal direction when the support structure is mounted in the second orientation relative to the base.

19. The bow sight of claim 18, wherein the sight pins are moved along the lengths of the slots to adjust the sight pins up and down relative to one another when the support structure is in the first orientation relative to the base, and wherein the sight pins are moved generally perpendicular relative to the lengths of the slots to adjust the sight pins up and down relative to one another when the support structure is in the second orientation relative to the base.

* * * * *